US005363115A

United States Patent [19]

Lipkin et al.

[11] Patent Number: 5,363,115

[45] Date of Patent: Nov. 8, 1994

[54] PARALLEL-CONDUCTOR TRANSMISSION LINE ANTENNA

[75] Inventors: Charles L. Lipkin, Naperville; Frederick W. Schmidt, Frankfort, both of Ill.

[73] Assignee: Andrew Corporation, Orland Park, Ill.

[21] Appl. No.: 66,911

[22] Filed: May 24, 1993

Related U.S. Application Data

[63] Continuation of Ser. No. 824,597, Jan. 23, 1992, abandoned.

[51] Int. Cl.[5] ..... H01Q 1/42

[52] U.S. Cl. ..... 343/872; 343/878; 343/DIG. 1

[58] Field of Search ..... 343/826, 878, 702, 872, 343/873, 795, DIG. 1; H01Q 1/40, 1/42, 1/38, 1/12, 1/22

[56] References Cited

U.S. PATENT DOCUMENTS

| | | | |
|---|---|---|---|
| 2,411,555 | 11/1946 | Rogers | 178/44 |
| 2,588,610 | 3/1952 | Boothroyd et al. | 343/872 |
| 2,750,589 | 6/1956 | Harris | 343/873 |
| 2,785,399 | 3/1957 | Harris | 343/872 |
| 3,757,342 | 9/1973 | Jasik et al. | 343/700 MS |
| 3,781,894 | 12/1973 | Ancona et al. | 343/872 |
| 4,031,537 | 6/1977 | Alford | 343/872 |
| 4,220,956 | 9/1980 | Sanford | 343/706 |
| 4,287,518 | 9/1981 | Ellis | 343/795 |
| 4,475,107 | 10/1984 | Makimoto et al. | 343/700 MS |
| 4,679,051 | 7/1987 | Yabu et al. | 343/700 MS |
| 4,893,130 | 1/1990 | Metivier | 343/715 |
| 4,914,449 | 4/1990 | Fukuzawa et al. | 343/872 |
| 5,006,858 | 4/1991 | Shirosaka | 343/700 |

FOREIGN PATENT DOCUMENTS

| | | | |
|---|---|---|---|
| 2632772A | 7/1976 | Germany . | |
| 54-37662 | 3/1979 | Japan . | |
| 57-99804 | 6/1982 | Japan . | |
| 58-97901 | 10/1983 | Japan | 343/700 MS |
| 100387 | 5/1988 | Japan | 343/873 |
| 2142475A | 6/1983 | United Kingdom . | |
| 2147744A | 10/1983 | United Kingdom | 343/700 MS |
| 2142782 | 1/1985 | United Kingdom | 343/872 |

OTHER PUBLICATIONS

M. A. Weiss, "Microstrip Antennas for Milimeter Waves", IEEE Transaction on Antennas and Propagation, vol. A. p. 29, No. 1 1/81.

*Primary Examiner*—Michael C. Wimer

*Attorney, Agent, or Firm*—Arnold, White & Durkee

[57] ABSTRACT

A microwave antenna has an elongated tubular radome made of a rigid nonconductive material, and an elongated unitary core made of a rigid dielectric material and telescoped within the radome in supporting engagement with the inner surface of said radome. A pair of conductive antenna elements are affixed to the surface of the core and extend along the length thereof. A microwave transmission line is connected to the antenna elements for transmitting electromagnetic energy to and from the elements.

17 Claims, 10 Drawing Sheets

PARALLEL-CONDUCTOR TRANSMISSION LINE ANTENNA

This application is a continuation of application Ser. No. 07/824,597, filed Jan. 23, 1992, now abandoned.

FIELD OF THE INVENTION

The present invention relates generally to microwave antennas and, more particularly, to an improved parallel-conductor transmission line antenna having multiple radiating elements spaced along a vertical axis. This antenna is useful in the frequency range of 500 to 10,000 MHz.

SUMMARY OF THE INVENTION

It is a primary object of the present invention to provide an improved microwave antenna which has an array of radiating elements disposed within a radome, and which can be quickly assembled from a small number of parts. In this connection, a related object of the invention is to provide such an improved antenna which can be efficiently manufactured at a relatively low cost, especially when made in large numbers.

It is another object of this invention to provide such an improved microwave antenna which facilitates accurate positioning and alignment of the radiating elements.

A further object of this invention is to provide an improved microwave antenna which is extremely stable during and subsequent to its installation, and which is extremely effective in clamping vibrations.

Still another object of this invention is to provide an improved microwave antenna which facilitates fabrication of each radiating element as a unitary part of the antenna.

Other objects and advantages of the invention will be apparent from the following detailed description and the accompanying drawings.

Figure 1A:
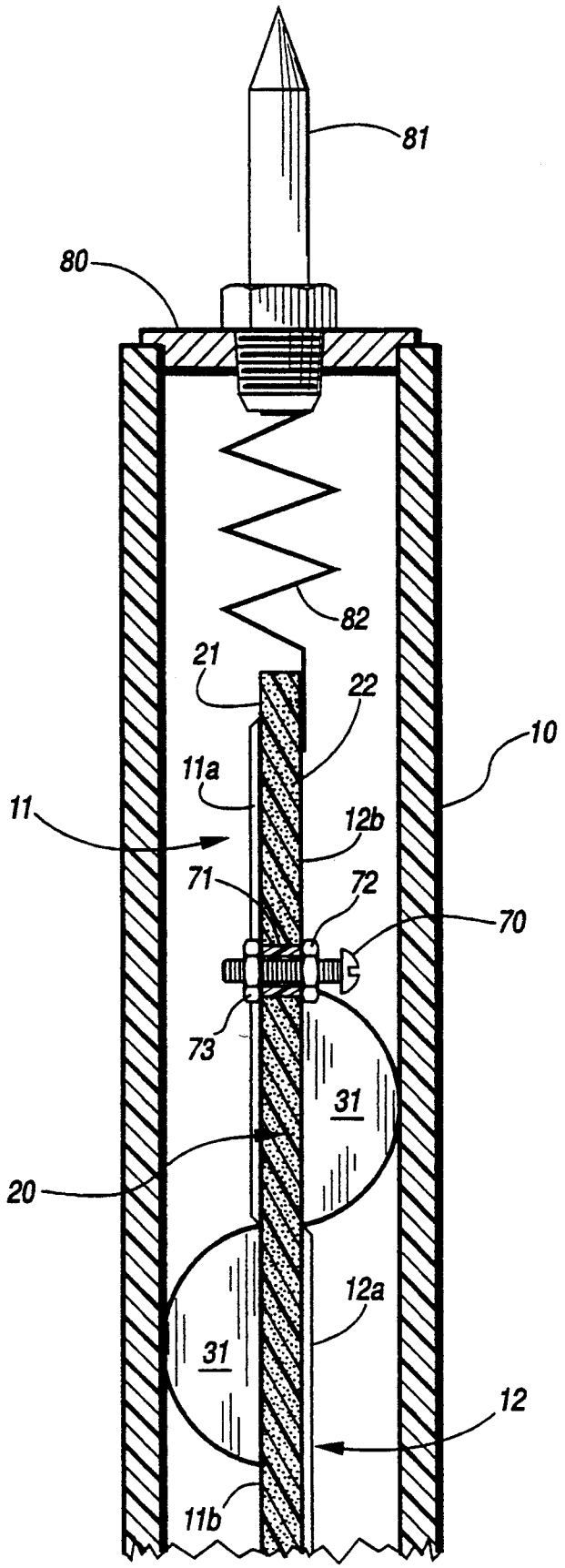
FIGS. 1A through 1D, when combined, form a longitudinal section taken through the middle of, and in a plane perpendicular to, the flat dielectric core of an antenna embodying the invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings and referring first to FIG. 1, there is shown a parallel-conductor transmission line antenna housed inside a cylindrical fiberglass radome 10. The radome 10 is of unitary construction and may be made of fiberglass-reinforced polyester or epoxy to provide a structurally stiff and strong cylindrical radome which is electrically non-conductive. A rigid metal support tube 10*a* at the lower end of the radome provides a supporting base for the radome and the entire antenna.

Figure 4:
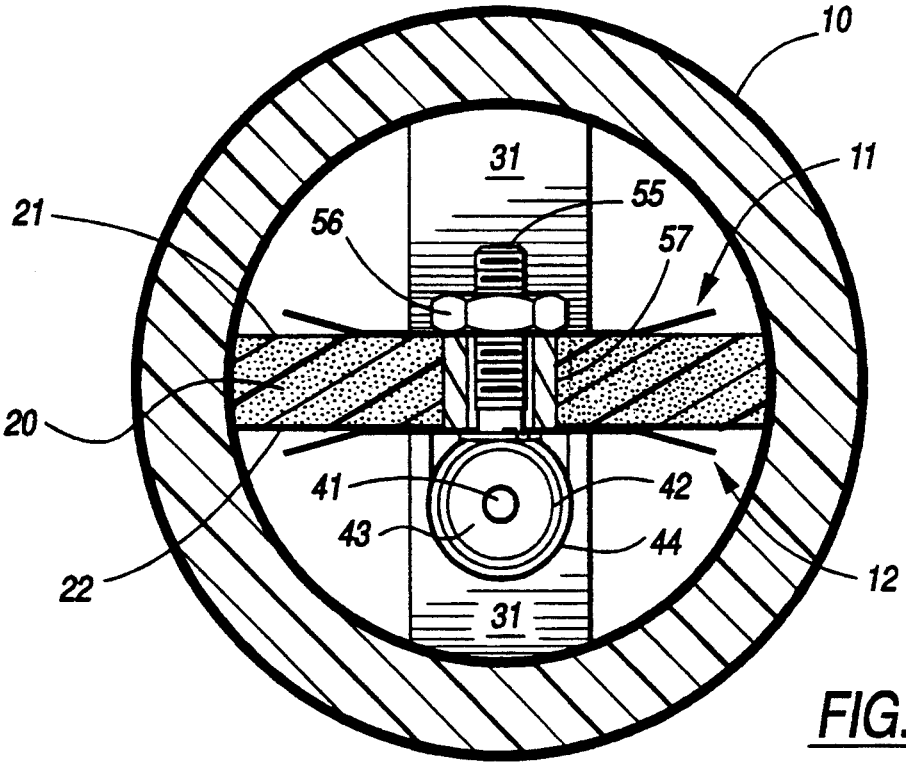
FIG. 4 is a transverse section taken generally along line 4—4 in FIGS. 1C and 2C.

Inside the radome 10, the parallel-conductor transmission line is formed by a pair of electrically conductive radiating elements 11 and 12 which extend along the length of the radome. Each of the two elements 11 and 12 includes alternating wide sections 11*a*, 12*a* and narrow sections 11*b*, 12*b*. The wide sections of each element 11 or 12 are arranged opposite the narrow sections of the other element. Energy radiating from the combination of the two elements 11 and 12 has a polarization that is parallel to the axis of the radome. The wide sections 11*a* and 12*a* of the two antenna elements are preferably bent at the edges in transverse section, as illustrated in FIG. 4.

Each of the antenna elements 11 and 12 is preferably punched or etched from a metallic sheet, e.g., a brass sheet having a thickness of 0.010 inches. The two elements 11 and 12 are arranged substantially parallel to one another, and the wide sections 11*a*, 12*a* are preferably shaped to inhibit the build-up of capacitive charges in the gap between the elements 11 and 12. This may be accomplished by using the illustrative obtuse-angled corners forming a non-rectangular shape for each wide section and by rounding the corners where the wide sections 11*a* or 12*a* meet the narrow sections 11*b* or 12*b*.

A more detailed description of the electrical characteristics of an antenna using antenna elements of the type described above is set forth in copending U.S. patent application Ser. No. 07/618,152, filed Nov. 23, 1990, abandoned, and assigned to the assignee of the present invention.

In accordance with one important aspect of the present invention, the conductive antenna elements 11 and 12 are fixed to the surface of an elongated unitary core 20 made of a rigid dielectric material and telescoped within the radome 10 in supporting engagement with the inner surface of the radome. In the illustrative embodiment, the dielectric core 20 is in the form of a diametral septum which provides a pair of parallel surfaces 21 and 22 for receiving and supporting the two antenna elements 11 and 12. The core 20 is preferably made of a dielectric foam, such as polyethylene foam having a density of 2 lbs/ft$^3$.

The unitary core 20 facilitates the fabrication of the antenna because the antenna elements 11 and 12 can be pre-formed and mounted directly on the core, after which the core is simply inserted into the radome 10. There is virtually no risk of damaging the antenna elements 11 and 12 because they are recessed from those surfaces of the core 20 which engage the radome 10. The core 20 can be installed in the radome 10 either by telescoping the core longitudinally into a one-piece radome, or by setting the core into one half of a radome formed from two semi-cylindrical sections, before the two radome sections are attached to each other.

If desired, the core 20 may be formed in the desired shape of the antenna elements 11 and 12 so that the antenna elements can be formed by coating, plating or depositing a conductive material directly onto selected areas of the core surface. For example, the antenna elements 11 and 12 could be formed by printing with conductive ink, by vapor deposition, by the application of thin metal foils, or by application of a conductive paint. In most cases, the requisite shape of the core can be achieved by extrusion or pultrusion of a dielectric foam. Alternatively, the foam may be formed in the desired shape by molding.

The unitary core 20 serves to both support and protect the conductive antenna elements 11 and 12. In addition, the core 20 serves as a vibration damper to further protect the antenna elements by preventing wind-induced oscillations from exciting the antenna's resonant frequencies of vibration. The core 20 also ensures precise positioning and alignment of the antenna elements within the radome. If desired, the engaging surfaces of the core and the radome may be provided with complementary registration surfaces which precisely fix the angular position of the core and the antenna elements thereon within the radome. Nor is there any possibility of the antenna elements shifting during or after installation of the antenna.

Perhaps most importantly, the core 20 enables the entire interior structure of the antenna, i.e., everything inside the radome 10, to be prefabricated as a single unit. The prefabrication of this unit can be highly automated, which in turn provides significant cost savings in high-volume production. Moreover, even when used to produce a small number of antennas, the prefabricated core can be made efficiently and ensures reliable, high-quality replication.

Figure 1B:
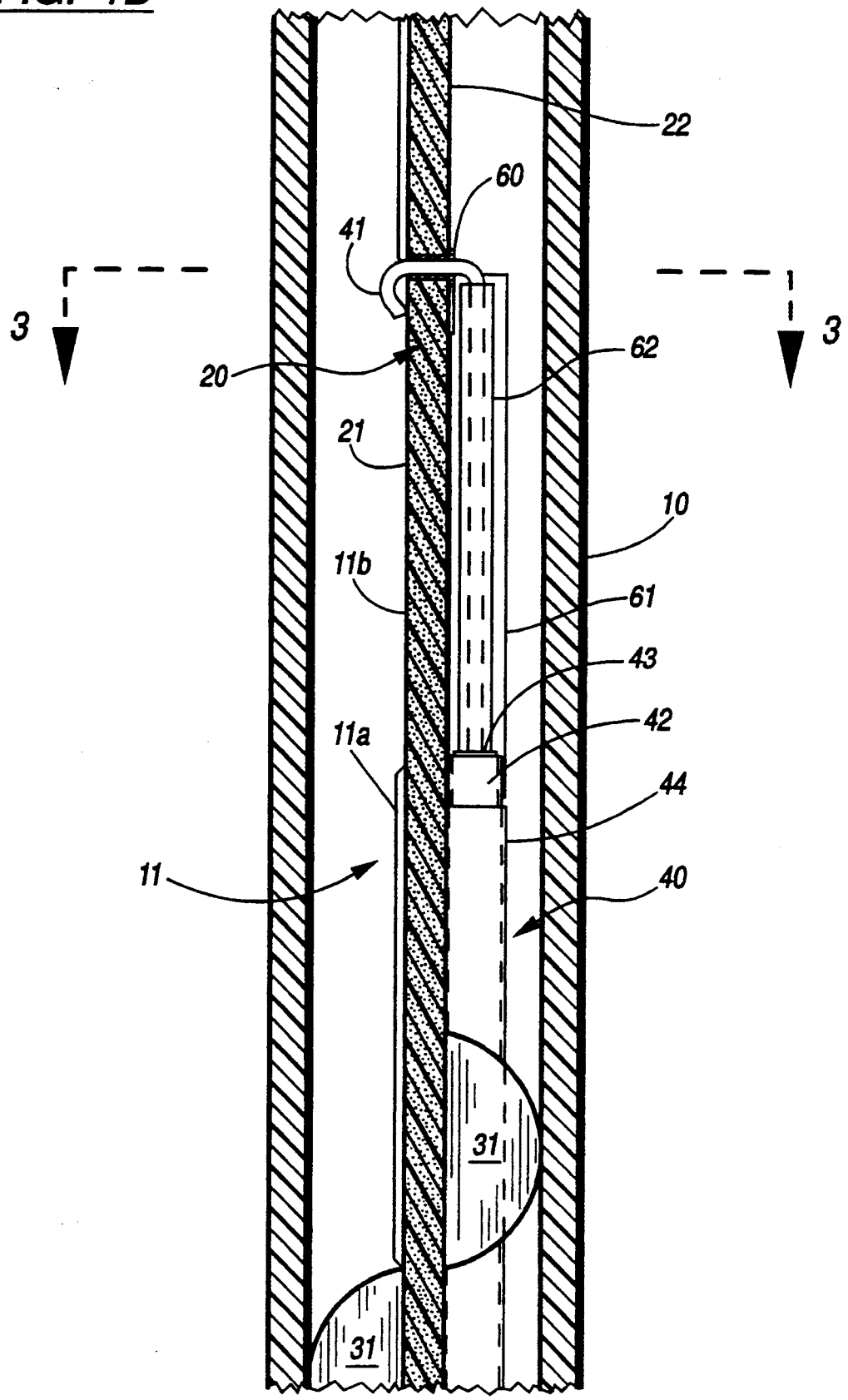
Figure 2A:
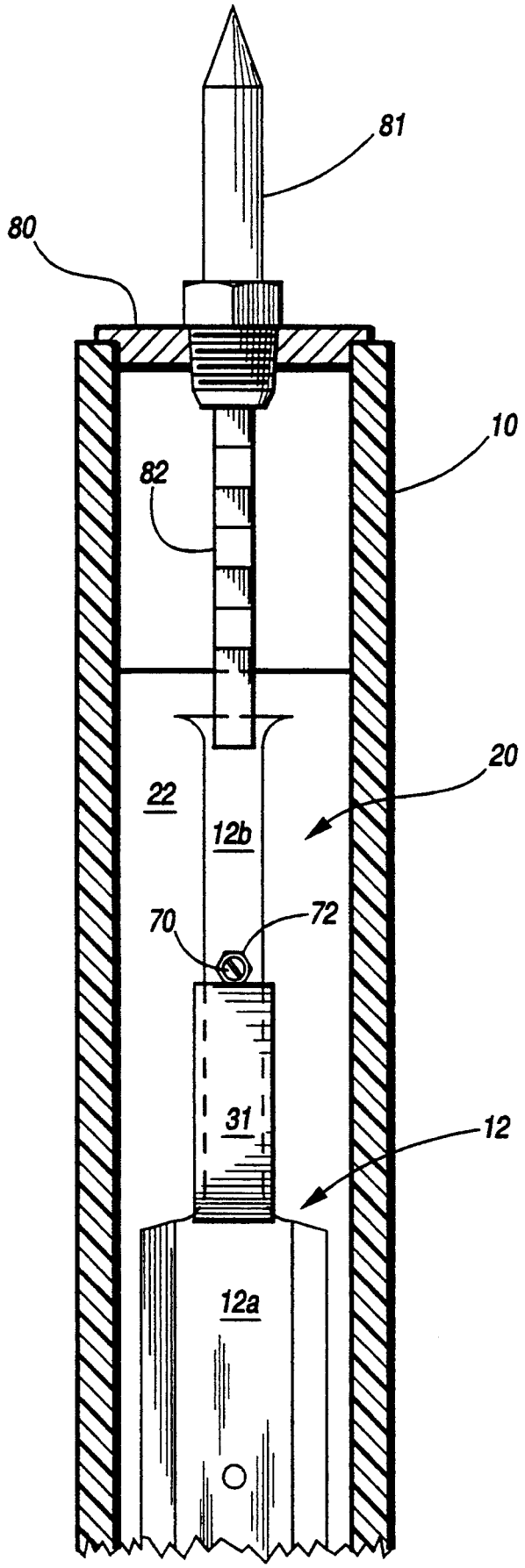
FIGS. 2A through 2D, when combined, form a longitudinal section taken through the radome of the antenna of FIGS. 1A–1D in a plane parallel to the flat dielectric core, and showing the structure inside the radome in side elevation.
Figure 2B:
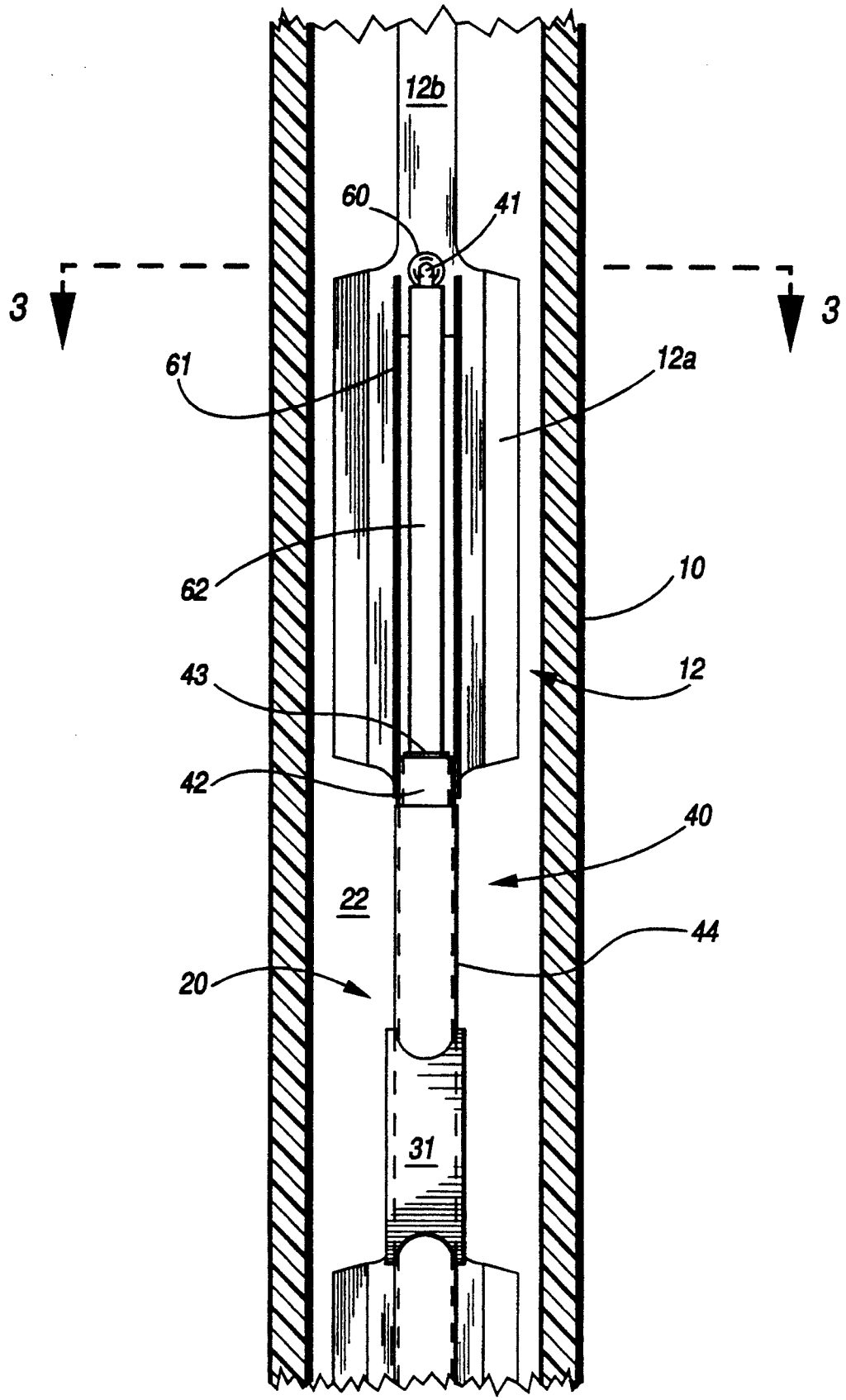

The dielectric core 20 is supported by a lateral support disc 30 (FIGS. 1D and 2D) which spans the inside diameter of the radome 10 near the lower end thereof, and a multiplicity of pairs of vibration dampers 31 (FIGS, 1A, 1B, 2A, 2B) located at uniform intervals along the length of the core. The support disc 30 and the dampers 31 are made of dielectric foam so that they allow the core 20 to give slightly, but yet prevent the core from vibrating at a natural resonant frequency. Each vibration damper 31 has a semi-circular shape in longitudinal cross section (FIGS. 1A, 1B), and the foam is sufficiently soft that the outer surface of each damper 31 conforms to the inside wall of the radome. The dampers 31 are located in the regions of the narrow sections **11*b* and 12*b* of the antenna elements because these narrow sections are completely flat on the surface of the core 20**.

The antenna is fed by a coaxial cable 40 which extends axially along one side of the core 20, in the space between the antenna element 11 and the radome 10. In the preferred embodiment the coaxial cable 40 has a stranded inner conductor 41 and a solid, smooth-walled outer conductor 42. The inner conductor 41 is held concentric within the outer conductor 42 by means of a dielectric sleeve 43. A protective polymeric jacket 44 surrounds the outer conductor 42.

Figure 5:
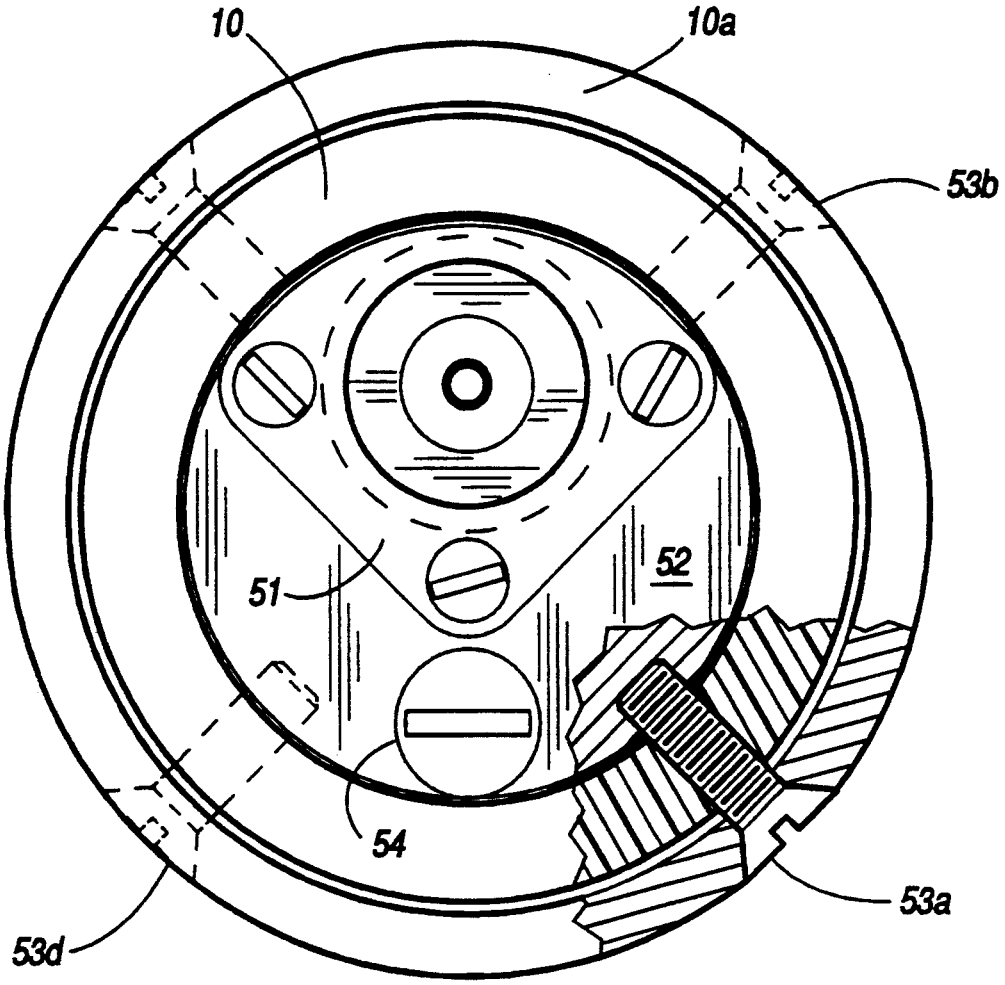
FIG. 5 is a bottom plane view of the antenna of FIGS. 1–4, with a portion broken away to show the internal structure.

The lower end of the coaxial cable 40 is connected to a feed cable (not shown) via a standard coaxial cable connector 51 at the lower end of the radome 10. The connector 51 is mounted on a rigid support disc 52 whose radially outer surface is provided with four threaded holes for receiving four screws **53*a–d* passing radially through the support tube 10*a* and the radome 10 (FIG. 5). These four screws 53*a–d* lock the support tube 10*a*, the radome 10, and the disc 52 firmly together. The disc 52 also receives a grounding screw 54. As the cable 40 extends along the core 20, the cable passes through cutouts in all the dampers 31 which are located on the same side of the core as the cable. These cutouts can be seen most clearly in FIG. 2B**.

Figure 1C:
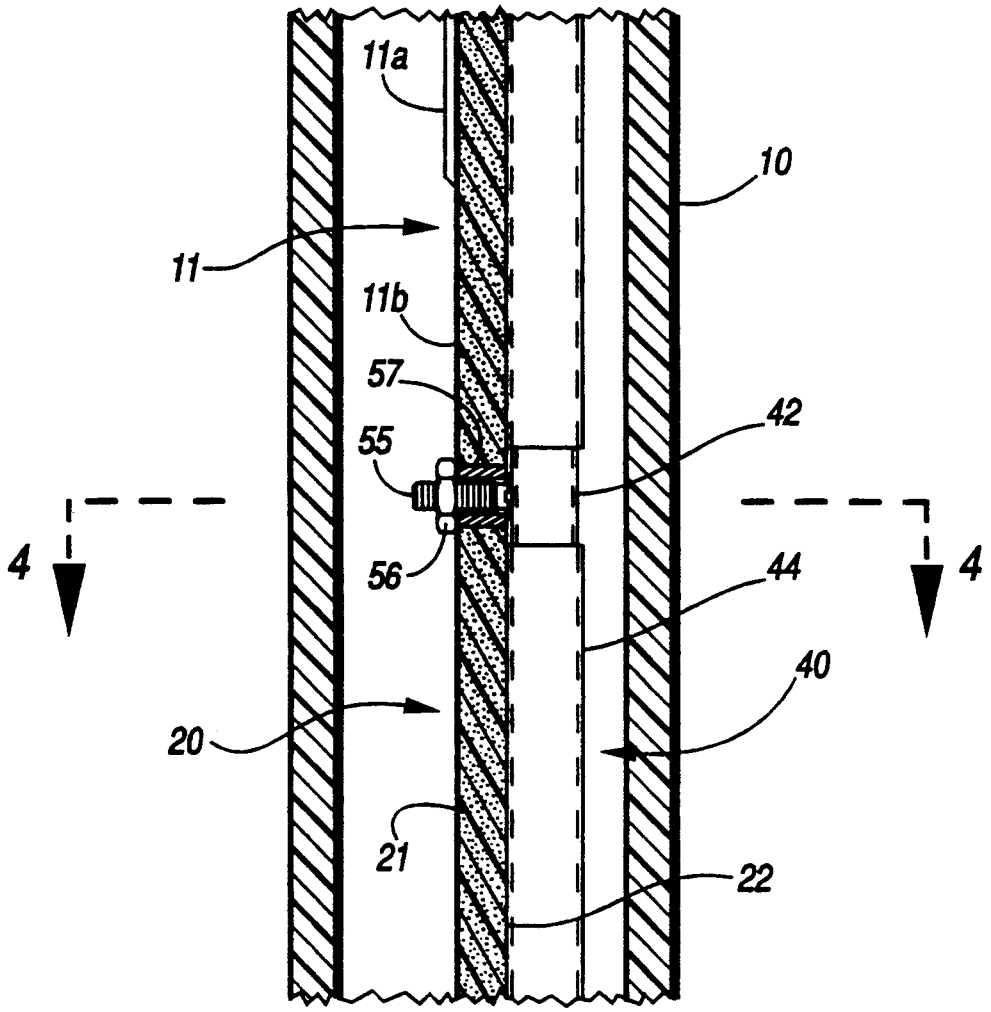
Figure 1D:
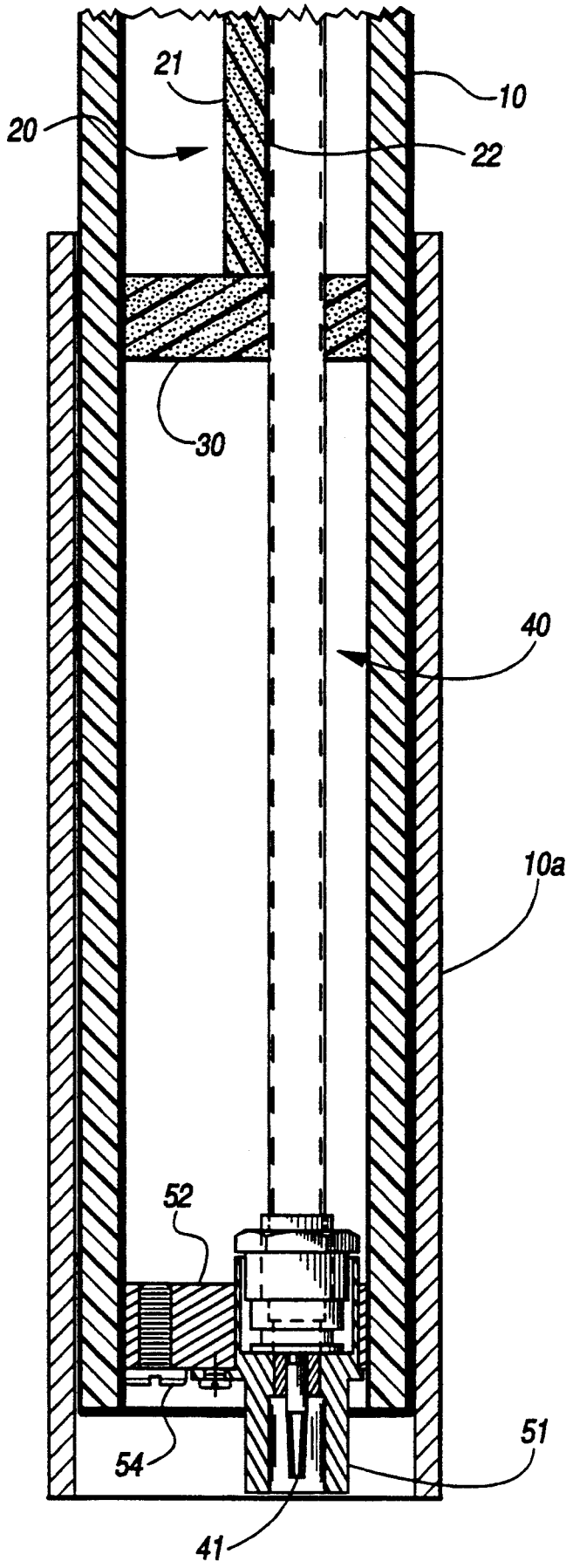
Figure 2C:
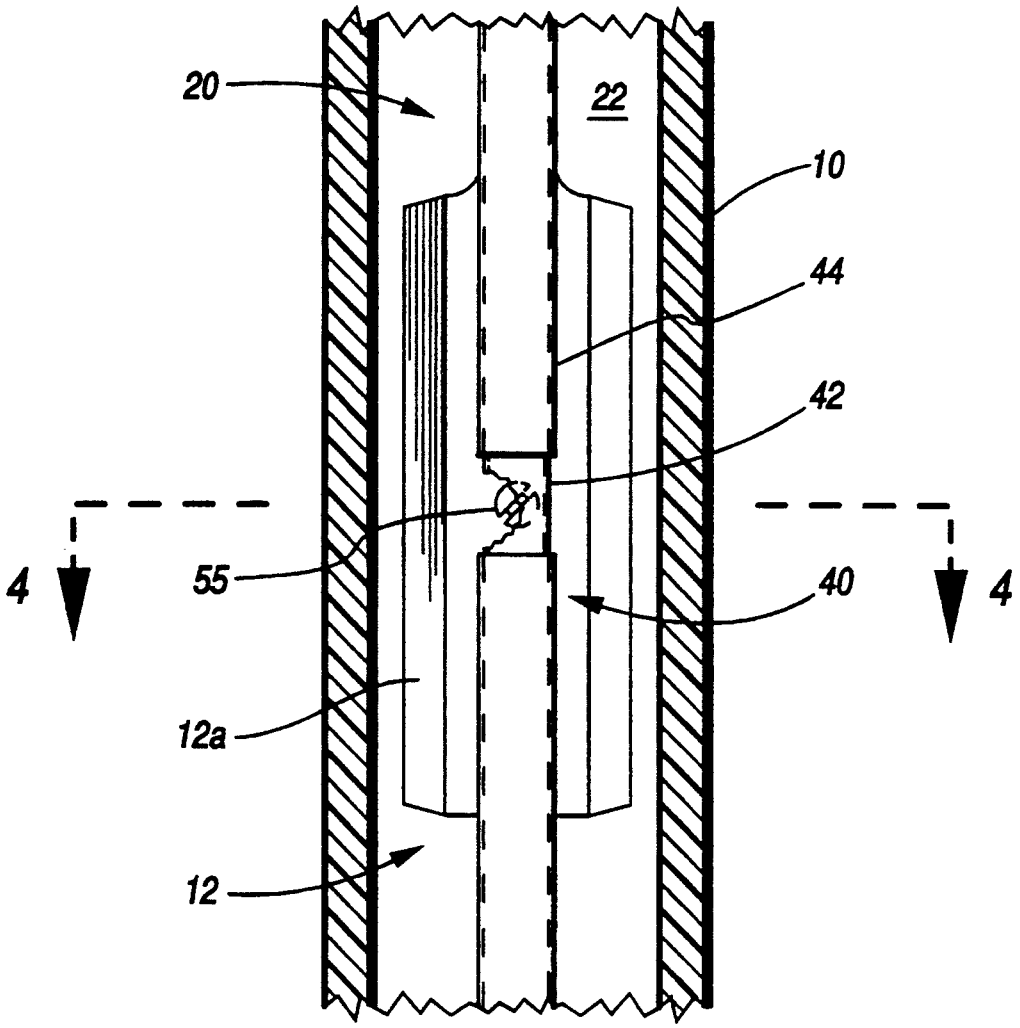
Figure 2D:
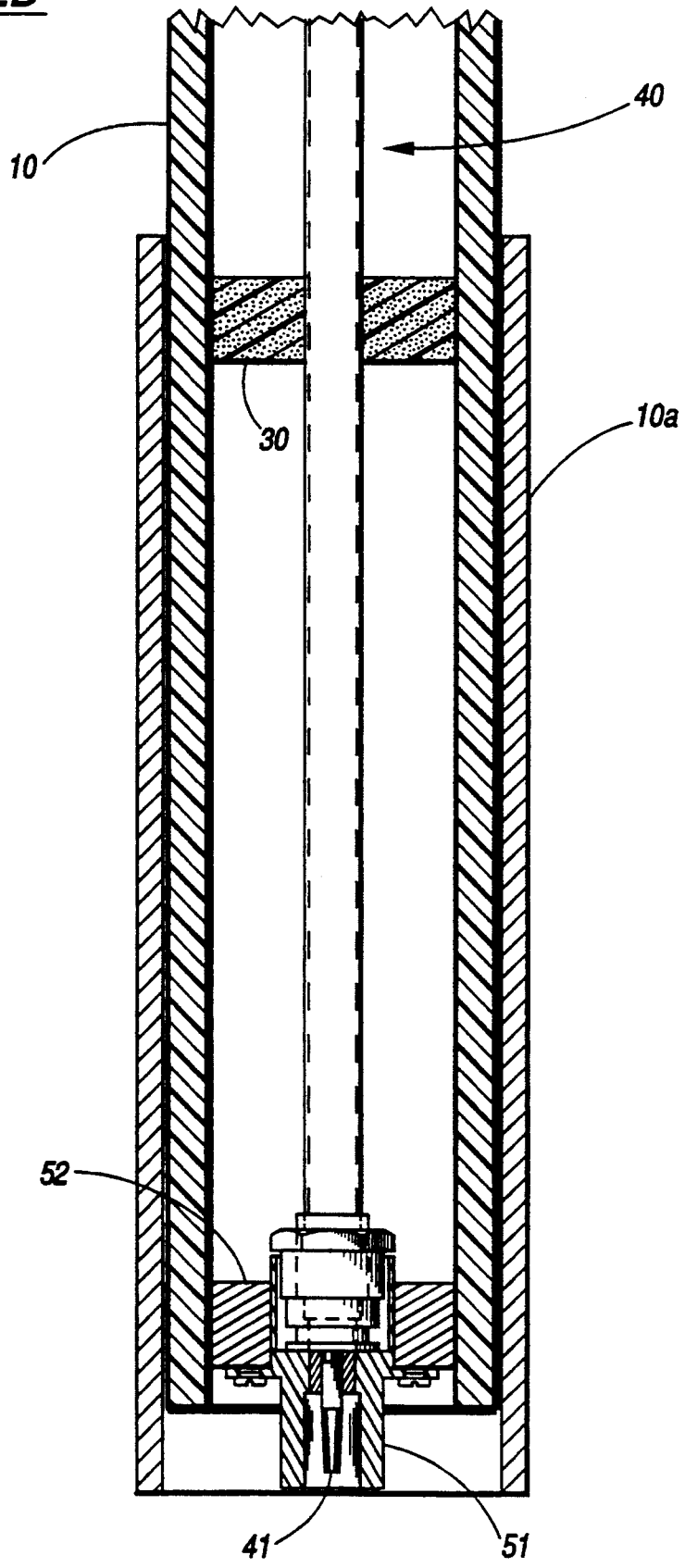

At the midpoint of the lowermost wide sections **11*a* of the antenna element 11, the two antenna elements 11 and 12 are shorted together by means of a conductive screw 55 and nut 56 (FIGS. 1C, 2C, 4). The head of the screw 55, is soldered to the antenna element 11. The shank of the screw 55 extends through a spacer sleeve 57 in the core 20, and the nut 56 on the shank is soldered to the second antenna element 12**.

Figure 3:
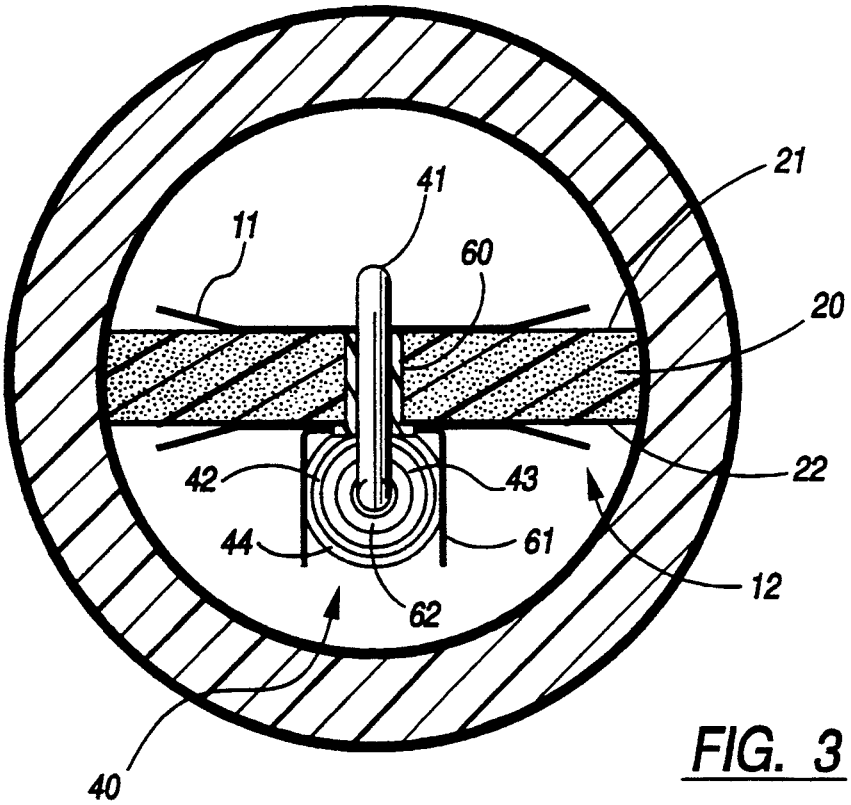
FIG. 3 is a transverse section taken generally along line 3—3 in FIGS. 1B and 2B.

To form a center, parallel-fed antenna, the upper end of the cable 40 is terminated midway along the lengths of the antenna elements 11 and 12, and the inner conductor 41 is electrically connected by soldering to the one antenna element 11 (FIGS. 1B, 2B, 3). In the illustrative embodiment this electrical connection is formed by stripping away the outer layers of the cable from a length of the inner conductor 41, and bending the exposed length of inner conductor through an insulating sleeve 60 which extends transversely through the core 20. On the opposite side of the core 20, the inner conductor 41 passes through the antenna element 12 and then is bent into engagement with, and soldered to, the adjacent narrow portion **12*b* of the element 12**. If desired, the feed point may be moved axially away from the midpoint of the antenna to achieve beamtilt, to fill nulls in the pattern and/or to vary the input VSWR.

For tuning purposes, a U-shaped conductive channel 61, preferably made of copper, is disposed between the upper end portion of the cable 40 and the antenna element 11 (FIGS. 1B, 2B, 3). The antenna can then be tuned by adjusting the axial position of the channel 61 before it is soldered to the antenna element 11. The outer conductor 42 of the coaxial cable 40 is connected to the antenna element 11 via the tuning channel 61. The outer conductor 42 extends only slightly into the channel, but the inner conductor 41 extends through the entire length of the channel. To ensure that the inner conductor 41 does not come into contact with the channel 61, a dielectric sleeve 62 is fitted over that portion of the inner conductor that is within the channel.

At the upper end of the core 20, the two antenna elements 11 and 12 are shorted together by a conductive metal bolt 70 which is connected to both antenna elements. The bolt 70 passes through a brass sleeve 71 inserted in a hole through the core 20. The electrical connections between the bolt 70 and the two antenna elements 11 and 12 are effected by a pair of nuts 72 and 73 threaded onto the bolt 70 and soldered to the respective antenna elements 11 and 12.

To protect the antenna from lightning, the upper end of the radome 10 is fitted with a conductive cap 80 carrying a lightning rod 81 which is connected to the antenna element 11 inside the radome by means of a flexible, conductive strap 82. In the event of a lightning strike, the resulting surge of electrical power is dissipated in the antenna so that the power surge does not reach the electronic equipment connected to the antenna. Such a power surge may destroy the antenna, which is much less expensive than the electronic equipment connected thereto.

While the invention has been described with specific reference to a center, parallel feed arrangement, it should be understood that other feed arrangements may be employed. For example, the antenna could be end fed by connecting the inner conductor of the coaxial cable 40 to one of the antenna elements 11 and 12, and by connecting the outer conductor of the cable to the other antenna element, at the lower ends of the elements. Alternatively, a center, series feed arrangement could be formed by severing one of the antenna elements midway along its length, and then connecting the inner and outer conductors of the coaxial cable 40 to different halves of the severed element and by shorting the two antenna elements together at both their upper and lower ends.

We claim:

1. A microwave antenna comprising, an elongated tubular radome made of a rigid nonconductive material and having an exterior surface and an interior surface;

an elongated, vibration-damping, unitary core made of a rigid dielectric material, said unitary core having a first element-affixing surface and a second element-affixing surface generally parallel to said first element-affixing surface, said unitary core further including a first supporting surface and a second supporting surface generally opposed to said first supporting surface, said unitary core being inserted within said radome and said first supporting surface of said unitary core shaped to form a first contacting yet unattached engagement between said first supporting surface and said inner surface of said radome and said second supporting surface shaped to form a second contacting yet unattached engagement between said second supporting surface and said inner surface of said radome without said inner surface of said radome contacting said first and second element-affixing surfaces, said first and second contacting yet unattached engagements between said core and said radome allowing said core to move relative to said radome after said core being inserted within said radome;

a plurality of conductive antenna elements affixed to said first and second element-affixing surfaces of said core and extending along a length thereof; and a microwave transmission line connected to said conductive antenna elements for transmitting electromagnetic energy to and from said elements.

2. The microwave antenna of claim 1 wherein said radome is a single unitary member.

3. The microwave antenna of claim 1 wherein said exterior surface of said radome interfacing with free space.

4. The microwave antenna of claim 1 wherein said core is made of dielectric foam.

5. The microwave antenna of claim 1 wherein said microwave transmission line is a coaxial cable.

6. The microwave antenna of claim 1 wherein said conductive antenna elements are recessed from said first and second supporting surfaces of said unitary core.

7. The microwave antenna of claim 1 which includes multiple resilient dielectric spacers spaced along a length of said core and extending between said core and said radome to damp vibrations of said core.

8. The microwave antenna of claim 1 which includes a support plate positioned inside said radome and secured thereto near a lower portion of the radome for supporting said core.

9. The microwave antenna of claim 1 wherein said core is in the form of a flat septum extending diametrally across the interior of said radome.

10. The microwave antenna of claim 1 wherein said first and second contacting yet unattached engagements are formed between said first and second supporting surfaces of said core and any generally opposing portions of said inner surface of said radome.

11. The microwave antenna of claim 7 wherein each of said plurality of conductive antenna elements having alternating narrow and wide sections.

12. The microwave antenna of claim 11 wherein said dielectric spacers positioned along said first and second element-affixing surfaces at intervals coinciding with said narrow sections of said plurality of conductive antenna elements.

13. A microwave antenna comprising, an elongated tubular radome made of a rigid nonconductive material and having an exterior surface and an interior surface;

a diametral septum in said radome, said septum being made of a rigid dielectric material, said diametral septum having a first element-affixing surface along the length of said septum and a second element-affixing surface generally parallel to said first element-affixing surface along the length of said septum, said diametral septum further including a first supporting surface along the length of said septum and adjacent to said first and second element-affixing surfaces and a second supporting surface generally opposed to said first supporting surface along the length of said septum and adjacent to said first and second element-affixing surfaces, said diametral septum being inserted within said radome and said first supporting surface of said diametral septum shaped to form a first contacting yet unattached engagement between said first supporting surface and said inner surface of said radome and said second supporting surface shaped to form a contacting yet unattached engagement between said second supporting surface and said inner surface of said radome without said inner surface of said radome contacting said first and second element-affixing surfaces, said first and second contacting yet unattached engagements between said septum and said radome allowing said septum to move relative to said radome after said septum being inserted within said radome;

a first elongated conductive antenna element affixed to said first element-affixing surface of said septum and a second elongated conductive antenna element affixed to said second element-affixing surface of said septum, said first and second conductive antenna elements extending along a length of said septum;

a microwave transmission line connected to said conductive antenna elements for transmitting electromagnetic energy to and from said elements; and dielectric spacers spaced along a length of said first and second element-affixing surfaces extending between said radome and said septum to damp vibrations of said septum.

14. The microwave antenna of claim 13 wherein said exterior surface of said radome interfacing with free space.

15. The microwave antenna of claim 13 wherein said first and second contacting yet unattached engagements are formed between said first and second supporting surfaces of said septum and any generally opposing portions of said inner surface of said radome.

16. The microwave antenna of claim 13 wherein said first and second elongated conductive antenna elements having alternating narrow and wide sections.

17. The microwave antenna of claim 16 wherein said dielectric spacers positioned along said first and second element-affixing surfaces at intervals coinciding with said narrow sections of said first and second elongated conductive antenna elements.

* * * * *

UNITED STATES PATENT AND TRADEMARK OFFICE

CERTIFICATE OF CORRECTION

PATENT NO. : 5,363,115

DATED : November 8, 1994

INVENTOR(S) : Charles L. Lipkin and Frederick W. Schmidt

It is certified that error appears in the above-indentified patent and that said Letters Patent is hereby corrected as shown below:

Column 1, Line 32, "clamping" should read -- damping --.

Signed and Sealed this

Seventh Day of March, 1995

*Attest:*

Bruce Lehman

BRUCE LEHMAN

*Attesting Officer*

*Commissioner of Patents and Trademarks*